US012622469B2

(12) United States Patent
Medic et al.

(10) Patent No.: US 12,622,469 B2
(45) Date of Patent: May 12, 2026

(54) METHOD FOR OPERATING AN ELECTRONIC VAPOR GENERATION DEVICE

(71) Applicant: XEOTECH GMBH, Berlin (DE)

(72) Inventors: Marko Medic, Amberg (DE); Michael Goch, Hannover (DE)

(73) Assignee: XEOTECH GMBH, Berlin (DE)

( * ) Notice: Subject to any disclaimer, the term of this patent is extended or adjusted under 35 U.S.C. 154(b) by 416 days.

(21) Appl. No.: 17/631,939

(22) PCT Filed: Jul. 31, 2020

(86) PCT No.: PCT/EP2020/071686
§ 371 (c)(1),
(2) Date: Feb. 1, 2022

(87) PCT Pub. No.: WO2021/019080
PCT Pub. Date: Feb. 4, 2021

(65) Prior Publication Data

US 2024/0032604 A1 Feb. 1, 2024

(30) Foreign Application Priority Data

Aug. 1, 2019 (DE) ..... 10 2019 120 851.3

(51) Int. Cl.
*A24F 40/53* (2020.01)
*A24F 40/42* (2020.01)
(Continued)

(52) U.S. Cl.
CPC ..... *A24F 40/53* (2020.01); *A24F 40/42* (2020.01); *A24F 40/57* (2020.01); *A24F 40/65* (2020.01)

(58) Field of Classification Search
None
See application file for complete search history.

(56) References Cited

U.S. PATENT DOCUMENTS

2014/0096782 A1* 4/2014 Ampolini ..... A24F 40/53 131/328
2016/0278435 A1 9/2016 Choukroun et al.
(Continued)

FOREIGN PATENT DOCUMENTS

DE 10 2018 100 949 A1 7/2019
WO WO2015158482 10/2015
(Continued)

OTHER PUBLICATIONS

European Decision to Grant a Patent for corresponding European Application No. 20 751 111.4, dated Feb. 6, 2024, 30 pages.
(Continued)

*Primary Examiner* — Manley L Cummins, IV
(74) *Attorney, Agent, or Firm* — Dority & Manning, P.A.

(57) ABSTRACT

A device and operational method for generating a consumable vapor includes: a holder and a detachable consumable cartridge. A controller is integrated with the holder to control the vapor generation device. The consumable cartridge includes a consumable product and a heater that heats the product to generate the vapor. An electric interface between the holder and the consumable cartridge transfers electric energy from the holder to the heater. A cartridge controller is integrated with the consumable cartridge. Once the consumable cartridge is attached to the holder, information is communicated via the electric interface between the cartridge controller and the holder controller for operation of the device.

18 Claims, 1 Drawing Sheet

(51) Int. Cl.
*A24F 40/57* (2020.01)
*A24F 40/65* (2020.01)

(56) References Cited

U.S. PATENT DOCUMENTS

| | | | | |
|---|---|---|---|---|
| 2017/0013879 | A1 | 1/2017 | Frisbee et al. | |
| 2017/0099878 | A1 | 4/2017 | Murison et al. | |
| 2017/0202266 | A1* | 7/2017 | Sur | A61M 11/041 |
| 2018/0043114 | A1* | 2/2018 | Bowen | A61M 15/003 |
| 2018/0060873 | A1 | 3/2018 | Chu | |
| 2018/0271149 | A1 | 9/2018 | Holtz et al. | |
| 2018/0271155 | A1 | 9/2018 | Baker et al. | |
| 2019/0183185 | A1 | 6/2019 | Manas et al. | |
| 2022/0322746 | A1 | 10/2022 | Talon | |

FOREIGN PATENT DOCUMENTS

| | | |
|---|---|---|
| WO | WO2019104227 | 5/2019 |
| WO | WO2019129866 A1 | 7/2019 |

OTHER PUBLICATIONS

European Office Action for corresponding European Application No. 20 751 111.4, dated Aug. 8, 2023, 5 pages.
German Patent Office Search Report, May 28, 2020.
PCT Search Report, Oct. 2, 2020.
Canadian Examination Search Report for corresponding Application No. CA3190264, dated Apr. 10, 2024. 5 pages.
Chinese Office Action (w/English translation) for Corresponding Application No. 202080069150.1, dated Dec. 24, 2024, 10 pages.

* cited by examiner

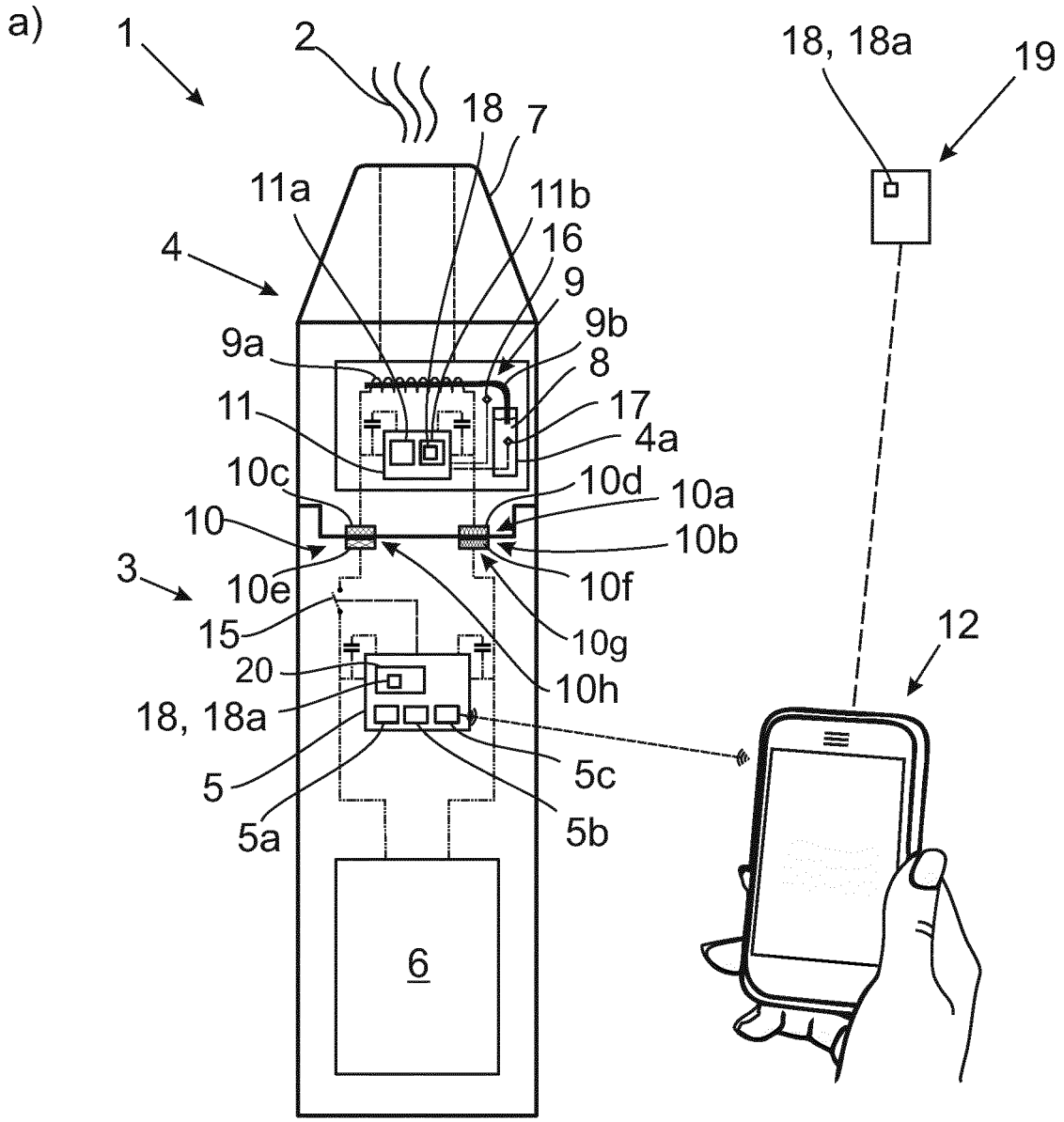
a)
1
2
18
7
18, 18a
19
11a
11b
16
4
9
9b
9a
8
11
17
4a
10c
10d
10a
10
10b
3
10e
10f
15
10g
12
20
10h
18, 18a
5c
5
5b
5a
6
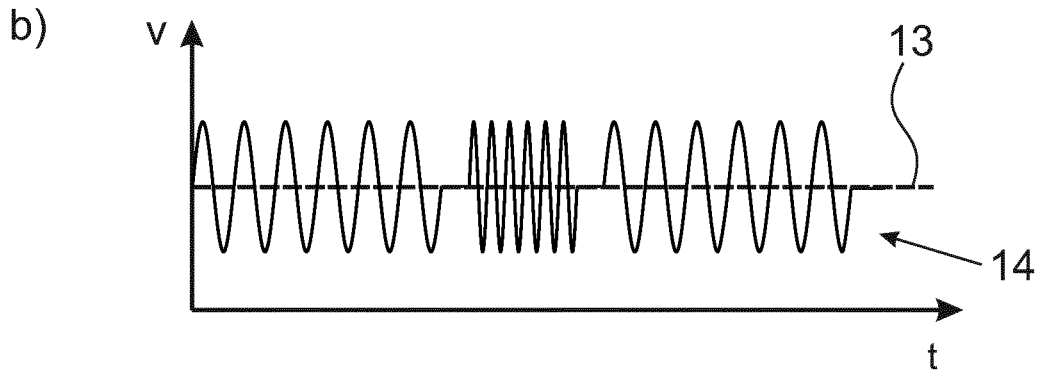
b)
v
13
14
t

METHOD FOR OPERATING AN ELECTRONIC VAPOR GENERATION DEVICE

FIELD OF THE INVENTION

The invention is directed to the method for operating an electronic generation device for generation of consumable vapor, to a consumable cartridge of an electronic vapor generation device according, to a holder of an electronic vapor generation device.

BACKGROUND

Electronic vapor generation devices (such as liquid vaporizers) for users to inhale consumable vapor are well known in the art.

Liquid vaporizers usually comprise a consumable in the form of a liquid, which is vaporized with a heater. Usually the liquid is placed in a chamber of the electronic vapor generation device which also comprises a heater for vaporizing it. The heater is often designed as a heating coil. A wick is provided, which transports the liquid from a chamber to the coil, where it is vaporized.

In those cases in which the cartridge can be attached to and detached from the holder, the cartridge usually comprises the chamber with the consumable and the heater. The energy for the heater is supplied from the holder to the heater via an electric interface.

In order to enhance the vaping experience of a user, the liquids and the heating of the liquids for vaporizing are optimized to each other. Also, an abuse of the device for substances with counterfeit cartridges should be prevented.

SUMMARY OF THE INVENTION

It is therefore an objective of the invention to improve the known methods for operating an electronic vapor generation device, such that a safe and satisfying consumption of consumable vapor is ensured. Additional objects and advantages of the invention will be set forth in the following description, or may be obvious from the description, or may be learned through practice of the invention.

The above noted objects are solved by the method for operating an electronic vapor generation device according to the features of the invention set forth herein. By providing a consumable cartridge that comprises a cartridge controller which is connected to an electric interface, a communication between the cartridge controller and the holder controller can be achieved in a very cost-efficient manner. Further, a better vaping experience for the user can be ensured, for example, by enabling authentication of the cartridge and/or by enhancing the control of the heater through the communication between the cartridge controller and the holder controller.

In detail, it is proposed that the consumable cartridge comprises a cartridge controller that is connected to the electric interface and wherein information is communicated via the electric interface between the cartridge controller and the holder controller.

The effect of providing a consumable cartridge with a cartridge controller and of using the electric interface as a communication channel is to be able to provide a communication between the cartridge and the holder controller in a very cost-efficient manner. The electric interface can be used for energy supply and communication. In particular, it is possible to perform authentication of the consumable cartridge and/or the user prior to vaping. Additionally, information for controlling the heater can be provided from the cartridge to the holder controller to enhance the control of the heater.

In a particular embodiment, the electric interface comprises a cartridge side with at least one contact and a holder side with at least one corresponding contact, which are electrically connected to each other when the cartridge is attached to the holder and which form a contact pair. Over at least one contact pair, energy for the heater is supplied and the respective information is communicated at least partly. This double use of at least one contact of the electric interface makes the interface very simple and the production of said cartridges cost-efficient. Generally, this double use of the electric interface between the holder and the cartridge not only allows to enhance the vaping experience by enabling the communication between the cartridge controller and the holder controller and by enabling authentication of the cartridge, it also provides this functionality at low cost. It is to be understood that in addition to this contact pair, normally, at least another contact pair is foreseen, which for example may provide an electrical reference potential such as a ground potential.

Preferably, two contact pairs are provided and the energy for the heater supplied as well as the information is communicated at least partly over both contact pairs. So to say, two contact pairs are used for supplying the heater with energy and also for the communication between the holder controller and the cartridge controller. Further, preferably, the energy for the heater is supplied via the electric interface as DC voltage, preferably with a rechargeable battery arranged in the holder. By this, the electronic vapor generation device can be designed as a handheld device in a very simple manner. The above noted information is preferably communicated between the cartridge controller and the holder controller in the form of a signal sequence switched onto the supply voltage of at least one contact of the electric interface. This is a very simple way to realize the double function of the electric interface. In a preferred embodiment, the cartridge controller is energized upon attachment of a cartridge and/or upon activation of the holder. By this, an energy supply of the cartridge by the holder via the electric interface can be realized in a constructive simple and cost-efficient manner.

Certain features allow very efficient authentication of the cartridge and/or of the user. The authentication enables the identification of counterfeit cartridges and thereby prevents the use of such cartridges and/or displays to the user that he uses a counterfeit cartridge.

In order to secure the communication between the consumable cartridge and the holder, the communication may be encrypted and/or decrypted. This further increases the security of the authentication.

In a further preferred embodiment, the amount of puffs taken may be determined and stored in the cartridge controller. By this, a refill of the cartridges with possibly counterfeit liquids can be identified and the use of such refilled cartridges can be prevented and/or displayed to the user.

A preferred method of control of the heater is described herein that provides improved and cost-efficient control of the heater.

Aspects of the invention are also directed to a consumable cartridge as such. Here it is of particular importance that the consumable cartridge comprises a cartridge controller that is connected to the electric interface and that the consumable cartridge is designed and configured for carrying out the method described herein. For further details with regard to this second teaching, reference is made to all explanations with regard to the first teaching.

Another teaching of the invention is directed to a holder of an electronic vapor generation device as such. For further details with regard to this teaching, reference is made to all explanations with regard to the prior teachings.

A further teaching is directed to an electronic vapor generation device. For further details with regard to this teaching reference is made to all explanations with regard to the prior teachings.

BRIEF DESCRIPTION OF THE DRAWINGS

In the following, the invention will be described with reference to the drawing:

FIG. 1 *a*) a schematic view of a proposed electronic vapor generation device for performing the proposed method and *b*) an exemplary signal sequence for communication via the energy supply at the electric interface of the electronic vapor generation device.

DETAILED DESCRIPTION

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The electronic vapor generation device 1 for generation of consumable vapor 2 shown in FIG. 1 *a*) comprises a proposed holder 3 and a proposed exchangeable consumable cartridge 4. The electronic vapor generation device 1, the proposed holder 3 and the consumable cartridge 4 are designed and configured for carrying out the proposed method. The holder 3 comprises a holder controller 5 for controlling the electronic vapor generation device 1. In the embodiment of FIG. 1, the holder 3 also comprises an in particular rechargeable battery 6. The consumable cartridge 4 is preferably battery-free.

The consumable cartridge 4 can be attached to and detached from the holder 3. In the embodiment of FIG. 1, the cartridge 4 comprises a mouthpiece 7 for inhaling the consumable vapor 2. Alternatively, the holder 3 may comprise the mouthpiece 7.

The consumable cartridge 4 comprises a consumable 8 and a heater 9 for heating the consumable 8 for generation of the consumable vapor 2. The consumable vapor 2 can then be inhaled by the user via the mouthpiece 7.

The consumable cartridge 4 comprises a chamber 4*a* for the consumable 8. The consumable 8 is filled into the consumable cartridge 4, here into chamber 4*a*.

The consumable 8 may be a liquid, in particular a nicotine containing liquid. It may additionally or alternatively contain herbal ingredients and/or medicinal drugs and/or hemp oil and/or cut tobacco and/or cut herbs.

In the embodiment of FIG. 1, the heater 9 is designed as a heating coil 9*a*. A wick 9*b* transports the consumable 8 from the chamber 4*a* to the coil 9*a*, where it is vaporized for generation of the consumable vapor 2.

Furthermore, the electronic vapor generation device 1 comprises an electric interface 10 between the holder 3 and the consumable cartridge 4. With the electric interface 10, electric energy can be transferred from the holder 3 to the cartridge 4 for supplying the heater 9 with electric energy. The consumable cartridge 4 comprises the cartridge side 10*a* of the electric interface 10 and the holder 3 comprises the holder side 10*b* of the electric interface 10.

According to the invention, the consumable cartridge 4 comprises a cartridge controller 11. The cartridge controller 11 is connected to the electric interface 10 and information is communicated via the electric interface 10 between the cartridge controller 11 and the holder controller 5. Through this, a double function of the electric interface 10 is provided, namely the energy supply of the consumable cartridge 4 and the communication between the cartridge controller 11 and the holder controller 5. This double functionality allows a very cost-competitive design of the electronic vapor generation device 1 and in particular of the exchangeable consumable cartridge 4. By this, on the one hand, a secure implementation of an authentication of the cartridge 4 is possible. On the other hand, the heating of the heater 9 may be optimized based on the communication between the cartridge controller 11 and the holder controller 5. This allows verification of the cartridge 4 and optimized control of the heater 9, both leading to a better vaping experience for the user.

The communication may be a one-way communication and/or two-way communication. Preferably, at least a communication from the cartridge controller 11 to the holder controller 5 takes place during operation of the electronic vapor generation device 1. This is explained in more detail further below.

It is to be understood, that the holder controller 5 may comprise a processor 5*a* and/or a memory 5*b* for carrying out the method. The holder controller 5 may be a microcontroller. Preferably, also a wireless unit 5*c*, preferably a Bluetooth chip, is provided for communication with a personal device 12 like a smartphone or the like. Over a wireless connection between the holder 3 and the personal device 12, the holder 3 may be updated. The cartridge controller 11 preferably comprises a logic unit and/or a processor 11*a* for carrying out the method described. The cartridge controller 11 may be an integrated circuit. It may also comprise a memory 11*b*. For a cost-effective production of the cartridges 4, the cartridge controller 11 may be integrated into the cartridge during the moulding process of the cartridge 4 itself. Preferably, it may be overmoulded together with the contacts 10*c*, 10*d* of the cartridge side 10*a* of the electric interface 10.

In the embodiment of FIG. 1, the cartridge side 10*a* of the electric interface 10 comprises at least one contact 10*c*, 10*d* and the holder side 10*b* of the electric interface 10 comprises at least one corresponding contact 10*e*, 10*f*. The corresponding at least one contact 10*e*, 10*f* of the holder side 10*b* and at least one contact 10*c*, 10*d* of the cartridge side 10*a* are electrically connected to each other when the cartridge 4 is attached to the holder 3. They form a contact pair 10*g*, 10*h*. Over at least one contact pair 10*g*, 10*h*, energy for the heater 9 is supplied as well as information is communicated at least partly. In the embodiment of FIG. 1, two contact pairs 10*g*, 10*h* are provided and energy for the heater 9 is supplied as well as the information is communicated at least partly via both contact pairs 10*g*, 10*h*. In the embodiment of FIG. 1, only two contact pairs 10*g*, 10*h* are provided between the holder 3 and the consumable cartridge 4. However, additional contact pairs 10*g*, 10*h* may be provided in alternative embodiments. Also, the cartridge controller 11 is preferably supplied with energy by the holder 3 in the same manner.

The energy for the heater 9 and/or for cartridge controller 11 may be supplied via the electric interface 10 using DC voltage. In the embodiment of FIG. 1, one contact 10*e* of the electric interface 10 supplies a regular supply voltage 13 and another contact 10*f* of the electric interface 10 is regular ground.

The information communicated between the cartridge controller 11 and the holder controller 5 is preferably in the form of a signal sequence 14 switched onto the supply voltage 13 of at least one contact 10*c*, 10*d*, 10*e*, 10*f* of the electric interface 10. Preferably, it is the contact supplying the regular supply voltage. Additionally or alternatively, it may be the contact for regular ground. In an embodiment, the information communicated is split and transferred as a signal sequence partly on the contacts 10*d*, 10*f* for regular supply voltage and another part on the contacts 10*c*, 10*e* for regular ground. However, in another embodiment, only one contact pair 10*h*, comprising one contact 10*e* of the holder 3 and one corresponding contact 10*c* of the cartridge 4, may supply energy and be used for communicating the information. In this case, another contact pair 10*g* may be provided, for example as a regular ground contact pair, which only supplies energy to the cartridge and does not participate in communicating the information.

It is to be noted, that the cartridge 4 may be designed, such that the contacts 10*c*, 10*d*, 10*e*, 10*f* being connected to each other may be switched between two attachments of the cartridge 4 to the holder 3 by rotating the cartridge 4 accordingly. It is to be noted, that such a switched attachment is preferably without implication on the operation on the electronic vapor generation device 1. Alternatively, such a switching may be prevented by a not shown mechanical anti-twist lock.

As can be seen in FIG. 1 *b*), the signal sequence 14 may be frequency modulated for transferring the information. The frequency of the frequency modulation is preferably above 1 KHz and/or below 8 MHz. It may be for example in the range of 1 KHz to 16 KHz and/or in the range of 100 KHz to 2 MHz and/or in the range of 1 MHz to 8 MHz. Additionally or alternatively, it may be amplitude modulated for transferring the information.

The information is preferably packed into a data package and the data package is transferred between the cartridge controller 11 and the holder controller 5 in the signal sequence 14.

Upon an attachment of the cartridge 4 to the holder 3 and/or upon activation of the holder 3, the cartridge controller 11 is energized, preferably at least for a predetermined time, in order to provide energy for the communication of information between the cartridge controller 11 and the holder controller 5. In the embodiment of FIG. 1, the cartridge controller 11 is energized by an energy burst of the holder 3 that is preferably shorter than 5 seconds, further preferably shorter than 3 seconds, further preferably around 1 second long. The attachment of the consumable cartridge 4 is detected in the embodiment of FIG. 1 by a resistance measurement between the contacts 10*e*, 10*f* of the holder 3. Then energy may be provided as described before.

This energy enables the cartridge controller 11 to communicate information to the holder controller 5. Based on this, the cartridge 4 (respectively, the cartridge controller 11) may authenticate itself to the holder 3, respectively the holder controller 5.

For controlling the energy supply from the holder 3 to the cartridge 4, the holder 3 may comprise a switch 15 that is controlled by the holder controller 5. Preferably, the holder controller 5 can only regulate the energy supply of the heater 9 and the cartridge controller 11 in combination. If the holder controller 5 cuts the energy supply, for example via switch 15, the energy supply to the heater 9 as well the cartridge controller 11 is cut. This applies preferably also for an increase or a reduction of the energy supply.

For authentication of the cartridge 4 to the holder 3, an authentication routine is provided. In the authentication routine, the information communicated from the cartridge controller 11 to the holder controller 5 via the electric interface 10 is verified and only upon a successful authentication routine, energy is supplied by the holder 3 to the heater 9 for a vaping session. Preferably, if the authentication routine is not successful, the energy supply from the holder 3 to the heater 9 and/or the cartridge controller 11 is cut and/or reduced, for example by opening the switch 15. Thus, if the information communicated cannot be verified, the authentication routine is not successful and the holder 3 does not provide sufficient energy for conducting a vaping session comprising several puffs.

Additionally or alternatively, an interaction of the user may be requested after the authentication routine has been unsuccessful in order to initiate an energy supply sufficient for a vaping session. This interaction may be on the electronic vapor generation device 1 or on a personal device 12 connected to the electronic vapor generation device 1. By this, a user may overrule the authentication routine. However, he is informed that a non-original cartridge is used.

Here and preferably, the information communicated from the cartridge controller 11 to the holder controller 5 comprises an identification code and/or the date of production and/or a temperature and/or a viscosity and/or additional information. The identification code may be a unique cartridge identification number. The temperature may be a temperature sensed by a temperature sensor 16 of the cartridge 4, which may be a sensor 16 for sensing the temperature of the heater 9 and/or the temperature of the consumable 8. The viscosity may be a viscosity of the consumable 8 sensed by a viscosity sensor 17 of the cartridge. The additional information may be additional information stored in the cartridge controller 11, for example, the amount of puffs taken from the cartridge 4. Whereas by communicating the temperature and/or viscosity, the control of the heater 9 may be optimized for improving the vaping experience. Counting the number of puffs taken from cartridge 3 allows to detect whether the cartridge 4 may have been refilled without authentication. If the number of puffs taken exceeds a predefined number of puffs, the authentication routine may also be regarded as unsuccessful, in particular by the holder controller 5, leading to the consequences described above in connection with an unsuccessful authentication. The information communicated from the cartridge controller 11 to the holder controller 5 may be at least partly encrypted. This increases the security of the communication and in particular of the authentication. It also makes it much more difficult to spoof the authentication and the use of counterfeit cartridges. In the embodiment of FIG. 1, the complete communication is encrypted.

The key 18 for encryption and/or the identification code and/or the date of production is preferably stored in the cartridge controller 11, in particular, the memory 11*b*, during the production process of the cartridge 4. Preferably, the storing takes place during an end of line test of the cartridge 4. The key 18 and/or a corresponding key 18*a* for decryption and/or the identification code and/or the date of production may also be stored in an external database 19.

In the embodiment of FIG. 1, all information sent from the cartridge controller 11 to the holder controller 5 is encrypted.

Preferably, the encryption takes place on the data package level. The data package sent for authentication may at least comprise the identification code and/or the date of production. Additionally, it may comprise the temperature and/or the viscosity and/or the additional information. Alternatively, the temperature and/or the viscosity and/or the additional information may be sent in a separate data package. Preferably, the majority of, in particular each, signal sequence respectively data package sent enables authentication of the cartridge 4.

The information communicated may be at least partly encrypted from the cartridge controller 11 to the holder controller 5 in two steps. In order to increase the security of the communication further, prior to encryption, additional data may be added to the information to be encrypted. For example, the additional data may be added between the first and the second step of encryption and/or prior to the first step of encryption.

In order to further secure the authentication and in order to prevent a re-engineering, the signal sequence for authentication of one cartridge 4 to the holder 3 is different for at least five, preferably for at least twenty consecutive authentications. Most preferably, every signal sequence for authentication of one cartridge 4 to the holder 3 is unique, in particular in its lifetime during normal use of the cartridge 4. This may be achieved by adding additional data as described before. This additional data may be, for example, a timer information and/or a random number. The timer information may regard the time of energy supply to the cartridge controller 11. Preferably, the additional data is determined or generated by the cartridge controller 11. In order to decrypt the information communicated the holder, controller 5 comprises a key 18, 18*a* for decryption. This may be a corresponding key 18*a* for decryption to the key 18 of the cartridge 4 or it may be the same key 18 as the one of the cartridge attached to the holder 3. Preferably, the holder 3 comprises a holder database 20 with a plurality of keys 18, 18*a* for decryption. At least one of those keys may enable the decryption of information communicated via the electric interface 10. For decryption, the holder controller 5 takes a first key 18, 18*a* from the holder data base 20 and tries to decrypt the information communicated. If the decryption is not successful, the holder controller 5 continues to take another key 18, 18*a* from the holder database 20 and tries to decrypt the information communicated, until successful decryption of the information communicated. For final verification, the decrypted information may be compared with information stored in the holder controller 5 for the key 18, 18*a* used for decryption. This may be the identification code and/or the production date. If this comparison is correct, the verification of the information communicated is successful. This leads in the embodiment of FIG. 1 to a successful authentication.

The key 18, 18*a*, respectively keys 18, 18*a* for decryption, are preferably at least partly stored in the holder database 20 during the production of the holder 3, preferably during the end of line testing. The holder database 20 may be updated via the personal device 12 later on by the user. New keys 18, 18*a* may be added to the holder database 20 and other keys 18, 18*a* may be deleted from this database 20 during these updates. Not only the keys 18, 18*a*, respectively corresponding keys 18, 18*a*, for decryption may be stored and/or updated, preferably also the corresponding identification numbers and/or production dates are stored respectively updated in the holder database 20 of the holder controller 5. The keys 18, 18*a* respectively corresponding keys 18, 18*a* are preferably updated via the personal device 12 from the external database 19. Additionally or alternatively, an authentication of the user is possible for example, an age verification may be implemented in this way. In this case, a key 18, 18*a* for decryption of the communication for a purchased cartridge 4 may only be provided to the holder 3, upon a successful age verification has been conducted. The age verification may be done via the mobile device 12 and the key 18, 18*a* may be provided to the personal device 12 for transferal to the holder 3.

Once the key has been received by the holder controller 5, it can decrypt the information communicated and the authentication of the cartridge can be performed as described. The age verification may be done for example over the internet. Such services are already known for different applications.

Additionally and/or alternatively, the holder controller 5 may send information to the cartridge controller 11 allowing to determine the amount of puffs taken from the cartridge 4. Here and preferably, the holder controller 5 receives from the cartridge controller 5 the information regarding the amount of puffs taken from the cartridge 4. Preferably after each puff, it sends updated information about the amount of puffs taken from the cartridge 4 back to the cartridge controller 5 for updating the stored amount of puffs. Alternatively, the cartridge controller 5 may count and store the amount of puffs itself. Here and preferably, the holder controller 5 controls the heating of the heater 9 by controlling the energy transferred and/or the voltage supplied to the cartridge. In the embodiment of FIG. 1, the energy transfer is controlled via the switch 15. In a generally preferred embodiment, the heater 9 is controlled based on information communicated via the electric interface 10. This may be in particular the temperature and/or the viscosity communicated as described above. It is to be noted, that the authentication routine is preferably carried out upon each attachment of a cartridge 4 to the holder 3 and/or upon each activation of the holder 4.

Modifications and variations can be made to the embodiments illustrated or described herein without departing from the scope and spirit of the invention as set forth in the appended claims.

The invention claimed is:

1. A method for operating an electronic vapor generation device for generation of consumable vapor, wherein the electronic vapor generation device includes:

a holder;

an exchangeable consumable cartridge that attaches and detaches from the holder, the exchangeable consumable cartridge including a consumable product and a heater that heats the consumable product to generate the consumable vapor;

a holder controller integrated with the holder and configured to control the electronic vapor generation device;

a cartridge controller integrated with the exchangeable consumable cartridge; and an electric interface between the holder and the exchangeable consumable cartridge that transfers electric energy from the holder to the exchangeable consumer cartridge for supplying the heater with electric energy, the electric interface including a cartridge side with one or more first contacts electrically connected to the cartridge controller, the electric interface including a holder side with one or more corresponding second contacts electrically connected to the holder controller, the first and second contacts forming at least one contact pair electrically connected to each other when the exchangeable consumer cartridge is attached to the holder;

the method comprising:

communicating information via one or more of the at least one contact pair of the electric interface between the cartridge controller and the holder controller; and supplying energy for the heater via the one or more of the at least one contact pair of the electric interface used for communicating the information, wherein the heater is controlled based on the information provided by the cartridge controller and communicated via the electric interface, and wherein the exchangeable consumable cartridge includes a temperature sensor configured to sense a temperature of the heater and the consumable product and a viscosity sensor configured to sense a viscosity of the consumable product; and wherein the information communicated includes the temperature and the viscosity.

2. The method according to claim 1, comprising supplying the energy for the heater via the one or more of the at least one contact pair of the electric interface as DC voltage.

3. The method according to claim 1, comprising communicating the information between the cartridge controller and the holder controller as a signal sequence switched onto a supply voltage of the heater supplied by at least one of the first or second contacts of one of the one or more of the at least one contact pair.

4. The method according to claim 1, wherein upon attachment of the exchangeable consumer cartridge to the holder or upon activation of the holder, the cartridge controller is energized to provide energy for communicating the information between the cartridge controller and the holder controller.

5. The method according to claim 1, wherein the information communicated from the cartridge controller to the holder controller comprises one or a combination of: an identification code, a date of production, the temperature, the viscosity, or additional information stored in the cartridge controller.

6. The method according to claim 1, further comprising providing an authentication routine wherein the information communicated from the cartridge controller to the holder controller via the electric interface is verified and only upon a successful authentication routine is energy supplied by the holder to the heater for a vaping session.

7. The method according to claim 6, wherein a signal sequence for authentication of the exchangeable consumer cartridge to the holder is different for at least five consecutive authentications routines.

8. The method of claim 7, wherein the signal sequence for each of the at least five consecutive authentication routines includes at least one of:

a respective time of energy supply to the cartridge controller; or a respective random number.

9. The method according to claim 1, wherein the information communicated from the cartridge controller to the holder controller is at least partly encrypted.

10. The method according to claim 9, wherein the encryption has at least a first step of encryption and a second step of encryption after the first step of encryption, wherein prior to the first step of encryption, additional data stored in the cartridge controller is added to the information to be encrypted.

11. The method according to claim 9, wherein the encryption has at least a first step of encryption and a second step of encryption after the first step of encryption, wherein between the first and second steps of encryption, additional data stored in the cartridge controller is added to the information to be encrypted.

12. The method according to claim 9, wherein prior to the encryption, additional data stored in the cartridge controller is added to the information to be encrypted.

13. The method according to claim 12, wherein the additional data includes at least one of:

a time of energy supply to the cartridge controller; or a random number.

14. The method according to claim 1, wherein the holder controller includes a holder database containing a plurality of decryption keys, the method comprising: using the decryption keys to decrypt the information communicated via the electric interface via the holder controller using a first decryption key attempt to decrypt the information, and if the decryption not successful using the first decryption key, the holder controller uses successive other decryption keys from the holder database to attempt to decrypt the information until successful decryption of the information is achieved.

15. The method according to claim 1, wherein the holder controller sends information to the cartridge controller for determining an amount of puffs taken from the exchangeable consumer cartridge.

16. The method according to claim 1, wherein the holder controller controls the heating of the heater by controlling the energy transferred or voltage supplied to the exchangeable consumer cartridge.

17. A consumable cartridge that is attachable to a holder of an electronic vapor generation device, comprising:

a chamber that stores a consumable product;

a heater configured to heat the consumable product to generate a consumable vapor;

a cartridge side component having one or more first contacts configured to contact one or more corresponding second contacts of a holder side component of an electric interface between the holder and the consumable cartridge, the first and second contacts forming at least one contact pair electrically connected to each other when the consumable cartridge is attached to the holder, the heater being electrically connected to the one or more first contacts, electric energy being transferable from the holder to the heater via one or more of the at least one contact pair of the electric interface; and a cartridge controller connected to the cartridge side component, the cartridge controller being electrically connected in parallel with the heater to the one or more first contacts, the cartridge controller being in communication with a holder controller via the electric interface when the consumable cartridge is attached to the holder, the cartridge controller being configured to communicate information as a signal sequence switched onto a supply voltage of the heater, the information being communicated between the cartridge controller and the holder controller via the one or more of the at least one contact pair of the electric interface used for transferring electric energy from the holder to the heater, the one or more second contacts being electrically connected to the holder controller, wherein the heater is controlled based on the information provided by the cartridge controller and communicated via the electric interface, wherein the consumable cartridge includes a temperature sensor configured to sense a temperature of the heater and the consumable product and a viscosity sensor configured to sense a viscosity of the consumable product; and wherein the information communicated includes the temperature and the viscosity.

18. An electronic vapor generation device for generation of consumable vapor, comprising:

a holder;

an exchangeable consumable cartridge that attaches and detaches from the holder, the exchangeable consumable cartridge including a consumable product and a heater that heats the consumable product to generate the consumable vapor;

a holder controller integrated with the holder and configured to control the electronic vapor generation device;

a cartridge controller integrated with the exchangeable consumable cartridge; and an electric interface between the holder and the exchangeable consumable cartridge, the electric interface including a cartridge side with one or more first contacts and a holder side with one or more corresponding second contacts, the one or more first contacts being electrically connected to the cartridge controller, the one or more corresponding second contacts being electrically connected to the holder controller, the first and second contacts forming at least one contact pair electrically connected to each other when the exchangeable consumable cartridge is attached to the holder, electric energy being transferred from the holder to the exchangeable consumable cartridge via one or more of the at least one contact pair of the electric interface for supplying the heater with electric energy;

wherein upon attachment of the exchangeable consumable cartridge to the holder, information for operation of the electronic vapor generation device is communicated between the cartridge controller and the holder controller via the one or more of the at least one contact pair of the electric interface used for transferring electric energy from the holder to the exchangeable consumable cartridge, wherein the heater is controlled based on the information provided by the cartridge controller and communicated via the electric interface, and wherein the exchangeable consumable cartridge includes a temperature sensor configured to sense a temperature of the heater and the consumable product and a viscosity sensor configured to sense a viscosity of the consumable product; and wherein the information communicated includes the temperature and the viscosity.

* * * * *